United States Patent [19]

Weishaupt

[11] Patent Number: 4,684,896

[45] Date of Patent: Aug. 4, 1987

[54] TESTING METHOD FOR IGNITION SYSTEMS OF INTERNAL COMBUSTION ENGINES IN MOTOR VEHICLES

[75] Inventor: Walter Weishaupt, Munich, Fed. Rep. of Germany

[73] Assignee: Bayerische Motoren Werke AG, Fed. Rep. of Germany

[21] Appl. No.: 671,914

[22] Filed: Nov. 16, 1984

[30] Foreign Application Priority Data

Nov. 19, 1983 [DE] Fed. Rep. of Germany ..... 3341880

[51] Int. Cl.[4] ..... F02P 17/00

[52] U.S. Cl. ..... 324/399; 324/380

[58] Field of Search ..... 324/399, 380, 381

[56] References Cited

U.S. PATENT DOCUMENTS 2,430,069 11/1947 Mesh .
4,053,823 10/1977 Adamian ..... 324/399 X
4,449,100 5/1984 Johnson et al. ..... 324/399 X

FOREIGN PATENT DOCUMENTS 2322834 11/1974 Fed. Rep. of Germany .
2608707 9/1977 Fed. Rep. of Germany .
2812236 8/1979 Fed. Rep. of Germany .
3151415 7/1983 Fed. Rep. of Germany .

*Primary Examiner*—Stanley T. Krawczewicz
*Attorney, Agent, or Firm*—Barnes & Thornburg

[57] ABSTRACT

A method and apparatus for testing ignition systems of internal combustion engines in motor vehicles, in which an ignition voltage signal on the primary side for one ignition operation or averaged for several ignition operations is compared with a should-be signal and the electrode distance of a spark plug is determined in that the should-be signal is taken at the beginning of a service interval and under an operating condition which at least approximately equals the actual operating condition at the point of time of the test.

17 Claims, 3 Drawing Figures

Figure 1A:
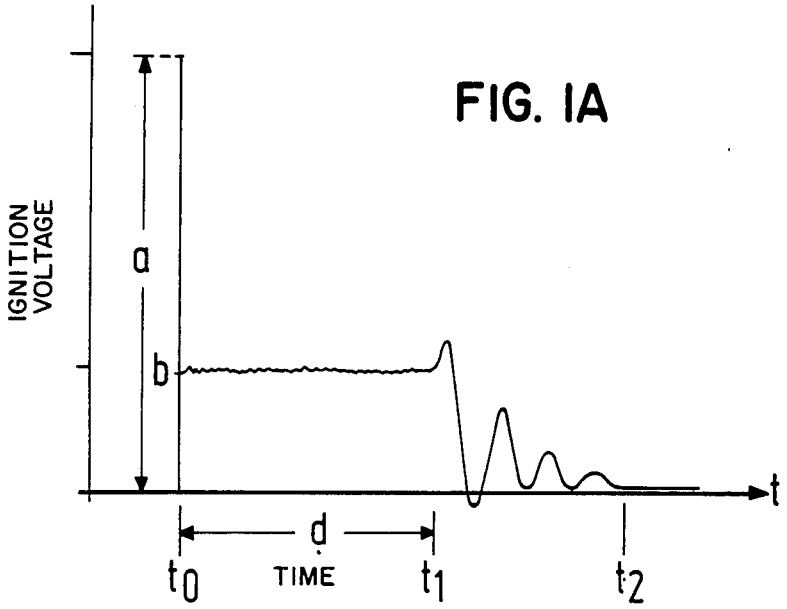

TESTING METHOD FOR IGNITION SYSTEMS OF INTERNAL COMBUSTION ENGINES IN MOTOR VEHICLES

The present invention relates to a testing method for ignition systems of internal combustion engines in motor vehicles.

With such a method as disclosed in the DE OS No. 23 42 895 the ignition system is examined or tested for proper functioning. For that purpose a characteristic value of the ignition voltage signal, for example, the maximum value is compared with a predetermined desired or should-be value. In the alternative, the ignition voltage signal can also be compared with a corresponding signal of another cylinder respectively the ignition voltage signals of all cylinders can be compared with each other. If these signals are equal among one another, the ignition system is in order, whereas if one or several of these signals differs strongly from one to another, the ignition system is probably defective. However, only a relatively coarse indication concerning the condition of the ignition system is possible therewith.

The present invention is concerned with the task to provide a testing method of the aforementioned type which provides a precise indication concerning the element determining the condition of the ignition system and therewith concerning the ignition system as such.

The present invention solves the underlying problems in that for testing the electrode distance of a spark plug, the desired or should-be signal is sensed at the beginning of a test interval and under an operating condition which is at least approximately identical to the actual operating condition at the test time.

The present invention starts with the fact that the condition of the ignition system is determined nearly exclusively by the spark plugs subjected to a wear since in particular with contactless ignition systems, further wear parts are not present. Known testing methods for spark plugs conclude from the magnitude of the secondary ignition voltage, the condition of the spark plugs (compare DE OS No. 23 22 834, DE OS No. 26 08 708 and U.S. Pat. No. 2,430,069). In contrast thereto, the present invention offers two significant advantages. On the one hand, the testing takes place by reference to the primary ignition voltage signal, whose amplitudes are far lower than the secondary signal. On the other hand, the testing takes place without interengagement into the ignition system whereas in the prior art spark plug testing methods the ignition voltage signal on the secondary side is fed externally with the aid of separate adapters. Finally, by taking into consideration the operating condition of the internal combustion engine, an interfering influence on the result of the test, which is triggered for example by the pressure, the temperature and the mixture ratio in the respective cylinder, is precluded. The present invention thus creates the possibility to determine continuously the wear of the spark plugs without interengagement into the ignition system and to supply at every instant during the operation a relative indication concerning the condition of the spark plugs.

This operating condition, may involve for example, coasting operation of the internal combustion engine. If the internal combustion engine is an engine with so-called coasting cutoff, i.e. interruption of the fuel supply in the coasting operation, the influence of the fuel air mixture on the test result is thereby completely excluded. In this case, the switch present for the recognition of the coasting operation, for example at the throttle valve, may be used for the purpose to initiate the testing process. However, also without coasting cut-off, the coasting operation offers the possibility to carry out the testing of the spark plug under approximately identical or constant test conditions. It is then additionally necessary to take into consideration the rotational speed respectively rotational speed curve of the internal combustion engine.

The testing period of time, over which the entire testing of the spark plug is to extend, can be selected freely and with any desired starting point. In contrast thereto it offers advantages to let the test period or interval commence with the initial installation of the spark plug. It is assured therewith that the spark plugs are in proper condition at the beginning of the test period and the changes of the primary ignition voltage signal are related to the overall wear of the spark plug.

The determination of the beginning of the test period can take place at will or with the aid of a signal automatically initiated during the execution of a servicing. It is prerequisite for the latter that it involves a servicing during which the spark plugs are routinely replaced.

Figure 1B:
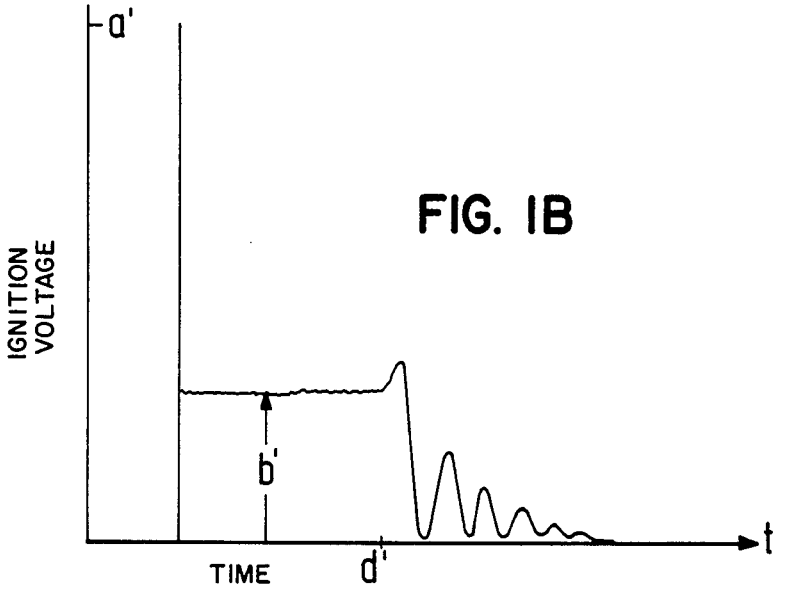
Figure 2:
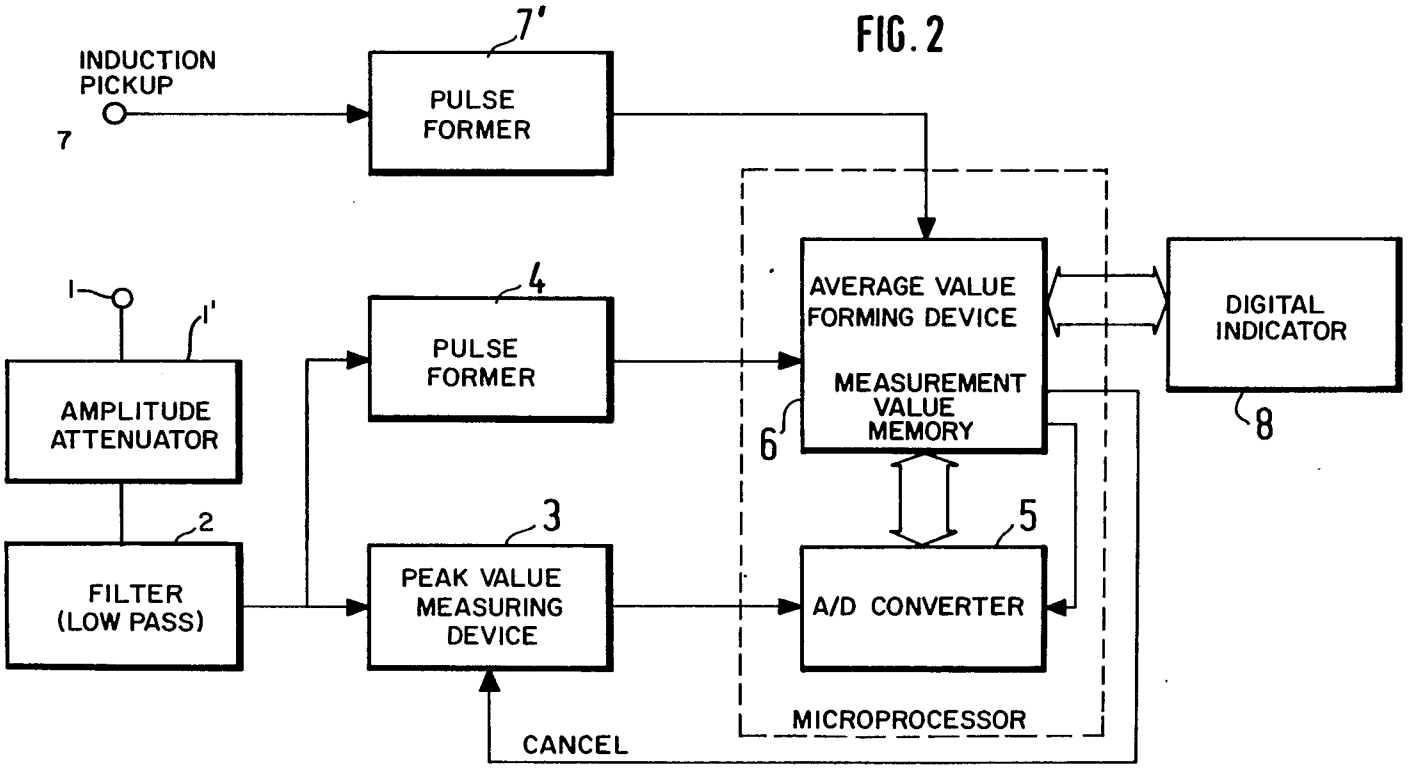

These and further objects, features and advantages of the present invention will become more aparent from the following description when taken in connection with the accompanying drawing which shows, for purposes of illustration only, one embodiment in accordance with the present invention, and wherein:

FIG. 1 illustrates two diagrams of the primary ignition voltage signal in an ignition system with a spark plug having a normal electrode distance FIG. 1A and an excessive electrode distance, (FIG. 1B); and FIG. 2 is a block diagram for the evaluation of the ignition voltage signal with a view to the wear of the spark plug.

Referring now to FIG. 1, the diagrams illustrated in this Figure reproduce the ignition voltage signal on the primary side of a spark plug with normal electrode distance, FIG. 1A, and with excessive electrode distance, FIG. 1B. It can be clearly recognized that the two ignition voltage signals differ significantly in three points. First, the maximum amplitude (a') is larger than miximum amplitude (a) with greater electrode distance. Secondly, the ignition voltage (b') is larger than ignition voltage (b) with greater electrode distance and thirdly, the combustion duration (d') is longer than combustion duration (a) with smaller electrode distance. The two FIGS. 1A and 1B thereby reproduce the curve of the ignition voltage signal at least under approximately the same operating condition of the internal combustion engine, in the instant case during coasting operation with cutoff fuel supply and identical engine rotational speed. Cause for the different curve of the ignition voltage signal on the primary side is a corresponding different curve of the ignition voltage signals on the secondary side (not shown). The latter, in turn, have their cause in the different electrical conditions dependent on the electrode distance for the ignition spark between the two electrodes of the spark plug which is present during the combusion duration (d).

The circuit indicated in block diagram in FIG. 2 serves the purpose to determine the ignition voltage amplitude a. For that purpose the ignition signal is sensed between an induction pick up (not shown) and an ignition coil (also not shown) (so-called terminal 1-signal) and is applied by way of amplitude attenuator 1' to a low pass filter 2, a peak value measuring device 3 and a pulse former 4. The output signal of the peak value measuring device 3 is digitized in an analog digital converter 5 and is stored in a measurement value memory device 6. The latter is triggered by the signal from an induction pick up 7 (not shown) with a pulse former 7' connected in its output. For a predetermined rotational speed respectively within a predetermined rotational speed range of the internal combustion engine the digital values of ignition voltage amplitudes are stored for the spark plug to be tested in a measurement value memory device 6 and are averaged. The rotational speed is thereby recongnized with the aid of the signals proportional to rotational speed which are supplied from the induction pick up 7 to the pulser former. The constant operating condition results with the aid of this rotational speed and an additional signal of, for example, a switch arranged at the throttle valve of the internal combusiton engine which is actuated with a closed throttle valve. As a result thereof, the ignition voltage amplitude is determined for this operating condition with the aid of averaging.

The testing method includes as a first step the determination of the ignition voltage amplitude in the manner described during start of use of the spark plug. For that purpose a signal is used which is routinely triggered when carrying out a servicing operation. With this desired or should-be value gained with the assistance of the spark plug to be tested itself, the respective ignition voltage amplitudes are determined now in the same manner, for example always when the same operating conditions of the internal combustion engine exist again, and are compared with the desired or should-be value in a processing stage 8 connected in the output thereof. Insofar as the actual value of the ignition voltage amplitude differs from this desired value by a predetermined amount, a warning signal is produced in a known manner respectively the wear degree of the spark plug is pointed out within the scope of a service-interval indication.

While I have shown and described only one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A method for an internal combustion engine of testing an ignition system having a repetitive cycle of operation comprising the steps of sensing at a predetermined operating condition of said engine a first instantaneous ignition voltage amplitude at a predetermined time instant in a cycle to produce a first output signal, storing said first output signal, sensing at said predetermined operating condition a second instantaneous ignition voltage amplitude at said predetermined time instant in a cycle subsequent to sensing of said first instantaneous voltage amplitude to produce a second output signal, and comparing said first output signal with said second output signal to produce an alarm signal.

2. A method according to claim 1, wherein the operating condition is a coasting operation of the internal combustion engine.

3. A method according to claim 2, wherein the operating condition is a coasting condition of the internal combustion engine with shut-off fuel supply.

4. A method according to claim 2, wherein the operating condition is determined by additional operating parameters of the internal combustion engine.

5. A method according to claim 4, wherein the test interval commences with start of use of a spark plug.

6. A method according to claim 5, wherein start of use of the spark plug is determined by carrying out a command initiated by a service operation.

7. A method according to claim 6, wherein said command is triggerable at will.

8. A method according to claim 1, wherein a test interval commences wtih a start of use of the spark plug.

9. A method according to claim 8, wherein start of use of the spark plug is determined by carrying out a command initiated by a service operation.

10. A method according to claim 9, wherein a command is trigerable at will.

11. A method in accordance with claim 1 wherein said predetermined operating condition comprises a predetermined speed of said engine.

12. A method of testing an ignition system for an internal combustion engine comprising the steps of repetitively sensing at a predetermined operating condition of said engine, a first instantaneous ignition voltage amplitude to produce a series of output signals respectively representative of said amplitudes, storing said series of output signals, determining the average value of said series of output signals, sensing at said predetermined operating condition a second instantaneous ignition voltage amplitude subsequent to said sensing of said first instaneous voltage amplitude to produce a second output signal, and comparing said average value of said series of output signals with said second output signal to produce an alarm signal.

13. A method in accordance with claim 12 wherein said predetermined operating condition comprises a predetermined speed of said engine.

14. Apparatus for testing an ignition system having a repetitive cycle of operation comprising means for sensing at a predetermined operating condition of said engine, a first instantaneous ignition voltage amplitude at a predetermined time instant in a cycle to produce a first output signal, means for storing said first output signal, means for storing a second instantaneous ignition voltage amplitude sensed at said predetermined operating condition at said predetermined time instant in a cyucle subsequent to sensing of said first instantaneous voltage amplitude to produce a second output signal, and means for comparing said first output signal with said second output signal to produce an alarm signal.

15. An apparatus in accordance with claim 14 wherein said predetermined operating condition comprises a predetermined speed of said engine.

16. Apparatus for testing an ignition system for an internal combustion engine comprising means for repetitively sensing at a predetermined operating condition of said engine, a first instantaneous ignition voltage amplitude to produce a series of output signals respectively representative of said amplitudes, means for storing said series of output signals, means for determining the average value of said series of output signals, means for storing a second instantaneous ignition voltage amplitude sensed at said predetermined operating condition subsequent to said sensing of said first instantaneous voltage amplitude to produce a second output signal, and means for comparing said average value of said series of output signals with said second output signal to procude an alarm signal.

17. Apparatus according to claim 16 wherein said predetermined operating condition comprises a predetermined speed of said engine.

* * * * *